United States Patent [19]

Sato

[11] Patent Number: 4,660,823

[45] Date of Patent: Apr. 28, 1987

[54] SHEET FEEDING DEVICE FOR BUSINESS MACHINE

[75] Inventor: Akira Sato, Tagata, Japan

[73] Assignee: Tokyo Electric Co., Ltd., Tokyo, Japan

[21] Appl. No.: 795,876

[22] Filed: Nov. 7, 1985

[30] Foreign Application Priority Data

Nov. 13, 1984 [JP] Japan ..... 59-238877

[51] Int. Cl.[4] ..... B65H 3/30

[52] U.S. Cl. ..... 271/22; 271/127; 271/164

[58] Field of Search ..... 271/126, 127, 22, 162, 271/164

[56] References Cited

U.S. PATENT DOCUMENTS 4,444,386 4/1984 Murata ..... 271/127
4,478,401 10/1984 Shibuya ..... 271/127 X
4,540,169 9/1985 Levinson ..... 271/164 X

*Primary Examiner*—Richard A. Schacher
*Attorney, Agent, or Firm*—Oblon, Fisher, Spivak, McClelland & Maier

[57] ABSTRACT

A sheet feeding device for a business machine includes a cassette and a cassette receiving station which cooperate to move sheets in the cassette toward a sheet feed roll after the cassette has been fully inserted and which also cooperate to move sheets in the cassette away from the sheet feed roll immediately before the cassette is withdrawn. Two projections extend from opposite sidewalls of the cassette and cooperate with grooves in the receiving station for facilitating cassette insertion and removal and for locking the cassette in place. Sheets in the cassette rest on top of a pressure plate. A pressure arm in the receiving station moves in an opening in the bottom of the cassette below the pressure plate to move the latter, thereby raising or lowering the sheets. A lug formed on the cassette engages an operating arm for the pressure arm upon insertion of the cassette.

5 Claims, 6 Drawing Figures

SHEET FEEDING DEVICE FOR BUSINESS MACHINE

FIELD OF THE INVENTION AND RELATED ART

The present invention relates to a sheet feeding device for a business machine such as a printer or a copying machine.

A conventional sheet feeding cassette has an open case having holding fingers for holding down the opposite corners of the top sheet of a pile of sheets, and a pressure plate placed in the open case for supporting the pile of sheets and urged upward so as to be vertically movable. Generally, such a sheet feeding cassette is mounted on a cabinet, and then a feed roller provided on the cabinet is pressed against the pile of sheets contained in the sheet feeding cassette to feed the sheets one by one.

In a sheet feeding device having such a construction, the sheet feeding cassette or the feed roller needs to be moved vertically relative to the other to separate the pile of sheets from the feed roller in inserting the sheet feeding cassette in and drawing-out the same from the cabinet. Accordingly, it is a usual practice to lower the sheet feeding cassette or the pile of sheets contained in the sheet feeding cassette by interlocked sheet feeding cassette inserting action and sheet feeding cassette drawing-out action. However, since the sheet feeding cassette or the pile of sheets is lowered by the sheet feeding cassette inserting action or the sheet feeding cassette drawing-out action, the sheet feeding cassette is moved with the feed roller in contact with the top sheet and the pile of sheets is not separated from the feed roller until the sheet feeding cassette is drawn by a small distance. While the sheet feeding cassette is drawn by a small distance with the feed roller in contact with the top sheet, the top sheet is rubbed by the feed roller, and hence the sheets are liable to be pressed out of the sheet feeding cassette and thereby the edges of the sheets are liable to be bent and the sheets are liable to be creased.

To solve such problems, there has been proposed a sheet feeding device in which the feed roller is lowered after the sheet feeding cassette has been completely inserted in the cabinet. However, such a construction for lowering the feed roller connected to a motor requires complicated power transmitting mechanism. In another conventional sheet feeding device, a lever is operated after a sheet feeding cassette has been completely inserted into the cabinet to push up the pressure plate mounted with a pile of sheets toward the feed roller. Such a sheet feeding device, however, has disadvantages that the operation of the lever is sometimes forgotten and the externally projecting lever spoils the aesthetic appearance of the machine.

OBJECT AND SUMMARY OF THE INVENTION

It is an object of the present invention to provide an accessible sheet feeding device for a business machine, capable of moving a pile of sheets contained in a sheet feeding cassette away from a feed roller immediately before drawing out the sheet feeding cassette.

As illustrated typically in FIG. 1, a sheet feeding device according to the present invention comprises: a case 20, which is inserted in a cassette receiving section 21 formed in a cabinet 1, provided with holding fingers 30 for holding-down the opposite front corners of sheets 28, a pressure plate 29 placed in the case for supporting the sheets 28, first projections 31 formed so as to project from the opposite sides of the front end of the case 20, second projections 32 formed behind the first projections so as to project from the opposite sides of the case 20 and having a length shorter than that of the first projections, and a lug 34 formed integrally with the case 20; guide grooves 43 formed in the opposite side walls of the cassette receiving section 21 so as to extend longitudinally for slidably receiving the first projections 31 and the second projections 32, or cassette guides 36 having such guide grooves 43 and attached to the opposite side walls of the case 20; openings 40 formed in the respective rear end portions of the guide grooves 43, respectively; slopes 42 extending from the openings 40 so as to decline toward the guide grooves 43 and formed so as to be associated only with the first projections, respectively; stopping surfaces 41 formed at the rear ends of the guide grooves 43, respectively, so as to be in contact with the rear sides of the second projections 32 when the case 20 is set on the cabinet 1; a pressure arm 45 disposed in the bottom wall of the cassette receiving section 21 so as to push up the pressure plate 29; an operating arm 48 provided on the side wall of the cassette receiving section 21 so as to be swingable on a pin and urged upward; and an extension spring 56 interconnecting the pressure arm 45 and the operating arm 48 as shown in FIG. 4.

In mounting the sheet feeding cassette 20 on the cabinet 1, the first projections 31 are fitted in the guide grooves 43 through the openings 40 and along the slopes 42, respectively, while the second projections 32 are fitted in the guide grooves 43 directly through the openings 40 without interfering with the slopes 42 so as to rest on the stopping surfaces 41, respectively. Thus, the sheet feeding cassette 20 is held in place. On the other hand, as the sheet feeding cassette 20 is being inserted in the cassette receiving section 21, the lug 34 of the sheet feeding cassette 20 pushes the operating arm 48 to turn the same clockwise, as viewed in FIG. 4, the turning motion of the operating arm 48 is transmitted through the extension spring 56 to the pressure arm 45, and thereby the pressure arm 45 raises the pressure plate 29 mounted with the sheets 28 to bring the top sheet 28 into contact with the feed roller 22. In drawing out the sheet feeding cassette 20, since the second projections 32 are resting on the stopping surfaces 41, first the rear end of the sheet feeding cassette 20 is lifted up before drawing out the sheet feeding cassette 20 from the cassette receiving section 21. At the moment when the rear end of the sheet feeding cassette 20 is lifted up, the operating arm 48 is allowed to return to the upper position, and thereby the pressure arm 45 is lowered. Thus, the sheets 28 are separated from the feed roller 22 before the sheet feeding cassette 20 is drawn outside. When the sheet feeding cassette 20 is drawn out, the first projections 31 are guided by the slope 42, and hence the first projections 31 never hit on the stepping surfaces 41.

Guide surfaces 37 formed in the respective rear sections of the cassette guides 36 so as to incline inward toward the interior of the cassette receiving section 21 and guide surfaces 38 formed also in the rear sections of the cassette guides 36 so as to decline inward of the cassette receiving section facilitate the insertion of the sheet feeding cassette 20. Furthermore, sliding surfaces 39 formed in the cassette guides 36, respectively, for guiding the first projections 31 and the second projections 32 facilitate bringing the first projections 31 and the second projections 32 to the openings 40. The sliding surfaces 39 support the second projections 32 at the initial stage of operation for drawing out the sheet feeding cassette 20 and at the final stage of operation for inserting the sheet feeding cassette 20 to hold the sheet feeding cassette 20 away from the operating arm 48 so that the sheets 28 will not be pressed against the feed roller 22. Furthermore, provision of a link 57 capable of transmitting the motion of the operating arm 48 with a play to the pressure arm 45 interlocks the operating arm 48 and the pressure arm 45 without greatly extending the extension spring 56.

DETAILED DESCRIPTION OF THE PREFERRED EMBODIMENTS

Figure 1:
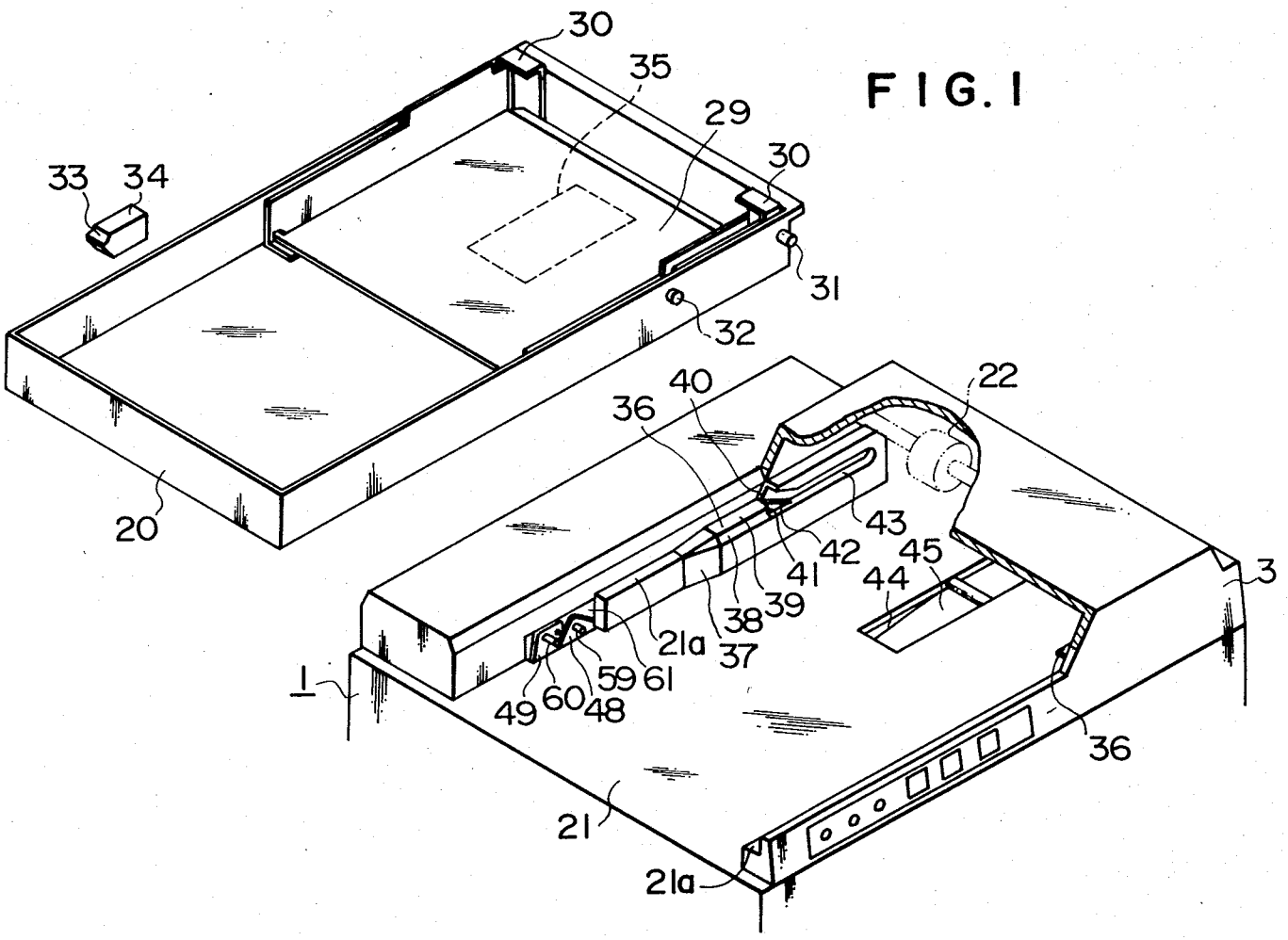
FIG. 1 is a partially cutaway exploded perspective view of a sheet feeding device according to the present invention.

A preferred embodiment of the present invention will be described hereinafter with reference to the accompanying drawings. Referring to the drawings, a cabinet 1 comprises a bottom housing 2 with the top thereof open, an upper housing 3 with the bottom thereof open, and a support shaft 4 pivotally connecting the bottom housing 2 and the upper housing 3. The bottom housing 2 and the upper housing 3 are detachably fastened together on the side opposite to the support shaft 4 by fastening means. A drum frame 7 is supported pivotally by a support shaft 5 on the bottom housing 2 so as to tend to turn counterclockwise, as viewed in FIG. 2, by the agency of the dead weight thereof and is positioned by a stopper 6.

A cylindrical photosensitive body 8 connected to a motor, not shown, is supported rotatably on part of the bottom housing 2, namely, on the drum frame 7. A charging unit 9, a toner supplying unit 10, a transfer unit 11, a lamp 12 and a cleaning unit 13 are arranged along the outer circumference of the photosensitive body 8. The bottom housing is further mounted with a fixing roller 14, a delivery roller 15, a pressure rooller 16 pressed against the delivery roller 15, a motor 17 for driving the delivery roller 15 and the fixing roller 14, and a sheet conveying unit 18.

A light source unit 19 which irradiates the photosensitive body 8 with a laser beam for optical scanning is held on the backside of the upper wall of the upper housing 3. A recess, namely, a cassette receiving section 21, for slidably supporting a sheet feeding cassette 20 at the opposite side walls and the bottom wall of the case of the sheet feeding cassette is formed opposite to the light source unit 19. A feed roller 22 connected to a motor, not shown, is provided in the interior of the cassette receiving section 21. A guide plate 23 and a guide plate 24 longer than the guide plate 23 are extended downard on one side of the upper housing 3. A guide plate 25 is provided on the bottom housing 2 so as to extend after the guide plate 24. A guide plate 26 is provided also on the bottom housing 2 opposite to the lower section of the guide plate 25. The guide plates 23 to 26 form a sheet guide 27 for guiding a sheet 28.

The sheet feeding cassette 20 has a pressure plate for supporting sheets 28 thereon, provided in the case of the sheet feeding cassette 20 so as to be vertically movably, and holding fingers 30 for holding down the opposite corners of the front edges of the sheets 28. The sheet feeding cassette 20 has first projections 31 projecting from the opposite sides of the front end of the case thereof, second projections 32 projecting from the opposite sides of the case behind the first projections 31, a lug 34 having a recess 33 and projecting from the left side wall, with respect to the direction of insertion of the sheet feed cassette 20, of the case, and an opening 35 formed in the front section of the bottom wall of the case. The first projections 31 are longer than the second projections 32.

Cassette guides 36 are fixed to the opposite side walls of the cassette receiving section 21, respectively. Each cassette guide 36 has, from the rear to the front thereof, a guide surface 37 inclined inward toward the front, a guide surface 38 declined inward, a supporting surface 39, an opening 40, a stopping surface 4 formed directly below the opening 40, a slope 42 declining from the opening 40 toward the front, and a guide grooves 43 for slidably receiving the first projection 31 and the second projection 32. The width of the slope 42 is half of the depth of the guide groove 43. The slope 42 is formed in the bottom of the guide groove 43 so as to guide only the first projection 31, which is longer than the second projection 32.

Figure 4:
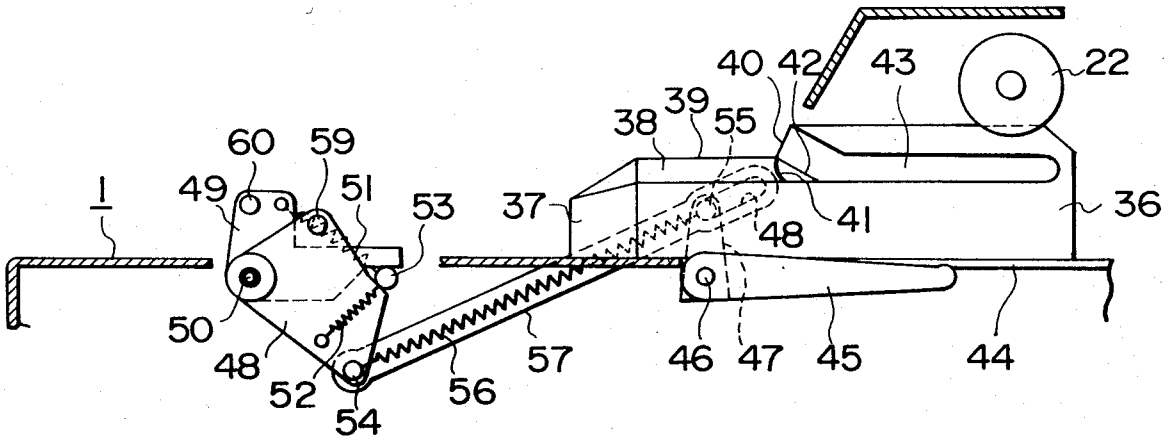
FIG. 4 is an enlarged longitudinal sectional side elevation of a cassette receiving section.

An opening 44 is formed in the front section of the bottom surface of the cassette receiving section 21 so as to allow a pressure arm 45 to project therethrough. A support shaft 46 fixed to the pressure arm 45 extends leftward beyond the left-hand cassette guide 36, and an intermediate arm 47 is fixed to the left end of the support shaft 46 as shown in FIG. 4. An operating arm 48 and a clamping lever 49 are supported pivotally on a support shaft 50 on the left side wall of the cassette receiving section 21. The clamping lever 49 is urged clockwise by a spring 51, while the operating arm 48 is urged counterclockwise by an extension spring 52. Both the operating arm 48 and the clamping lever 49 rest on a stopper pin 53. An extension spring 56 and a link 57 are extended between a pin 54 fixed to the operating arm 48 and a pin 55 fixed to the intermediate arm 47. The link 57 transmits the movement of the operating arm 48 with a play through the intermediate arm 47 to the pressure arm 45. A slot 58 is formed which receives the pin 55 therein is formed in one end of the link 57 to enable the idle movement oof the link 57. Pins 59 and 60 are fixed to the operating arm 48 and the clamping lever 49, respectively, so as to extend into the cassette receiving section 21.

Figure 2:
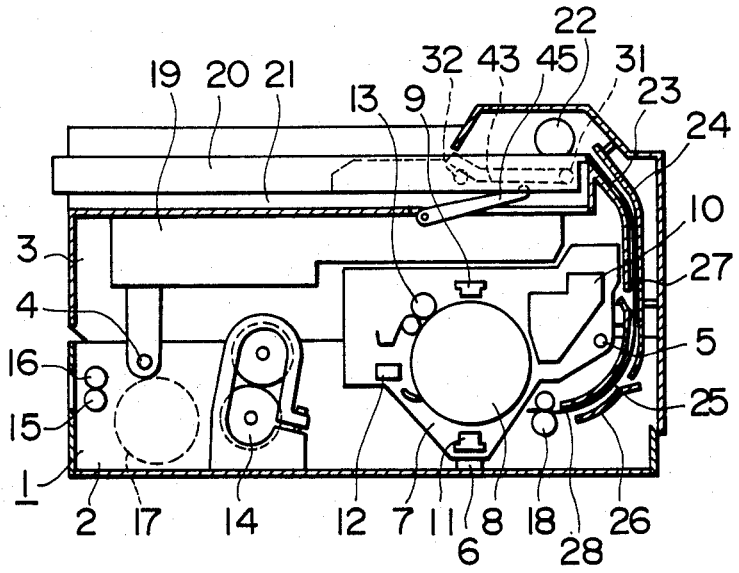
FIG. 2 is a reduced longitudinal sectional side elevation of a copying machine, showing the general constitution thereof.
Figure 3:
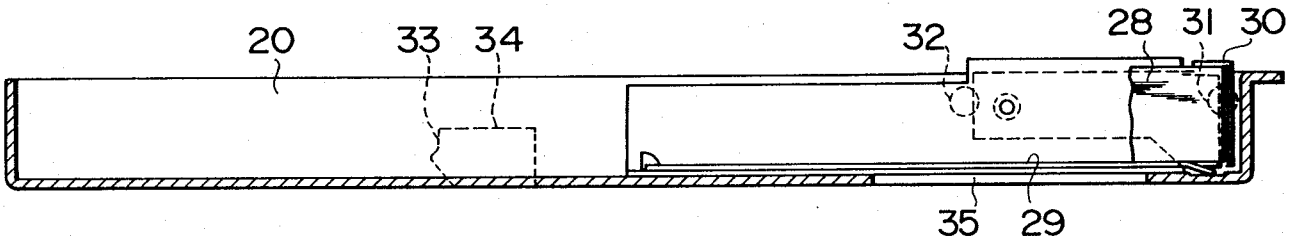
FIG. 3 is an enlarged longitudinal sectional side elevation of a sheet feeding cassette according to the present invention.

The manner of printing operation of the copying machine having such a constitution will be described hereinafter with reference to FIG. 2. While the photosensitive body 8 is turned through one full turn, a charged layer is formed over the outer circumference of the photosensitive body 8 by the charging unit 9; the charged layer is irradiated with a laser beam with the light source unit 19 to form an electrostatic latent image over the circumference of the photosensitive body 8; and a toner is supplied to the circumference of the photosensitive body 8 by the toner suppplying unit 10 to develop the electrostatic latent image. On the other hand, a sheet 28 drawn out by the feed roller 22 from the sheet feeding cassette 20 is guided by the sheet guide 27 and conveyed by the sheet conveying unit 18 to a position below the photosensitive body 8, where the toner image is transferred from the photosensitive body 8 to the sheet 8 by the transfer unit 11, then the toner image is fixed by the fixing roller 14, and then the sheet 28 is delivered outside the copying machine by the delivery roller 15 and the pressure roller 16.

The electrostatic latent image remaining on the photosensitive body 8 after the toner image has been transferred to the sheet 28 is erased by the light projected thereto by the lamp 12, and the residual toner is wiped off by the cleaning unit 13.

Figure 5:
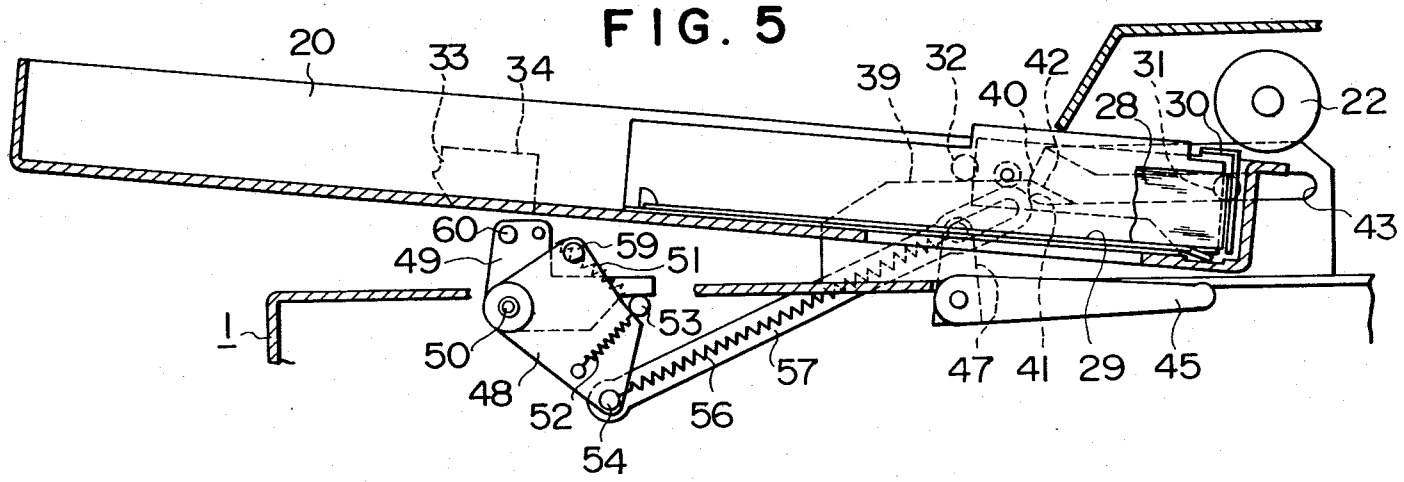
FIGS. 5 and 6 are enlarged longitudinal sectional side elevations of a sheet feeding cassette, for assistance in explaining sheet feeding cassette inserting and removing operations.
Figure 6:
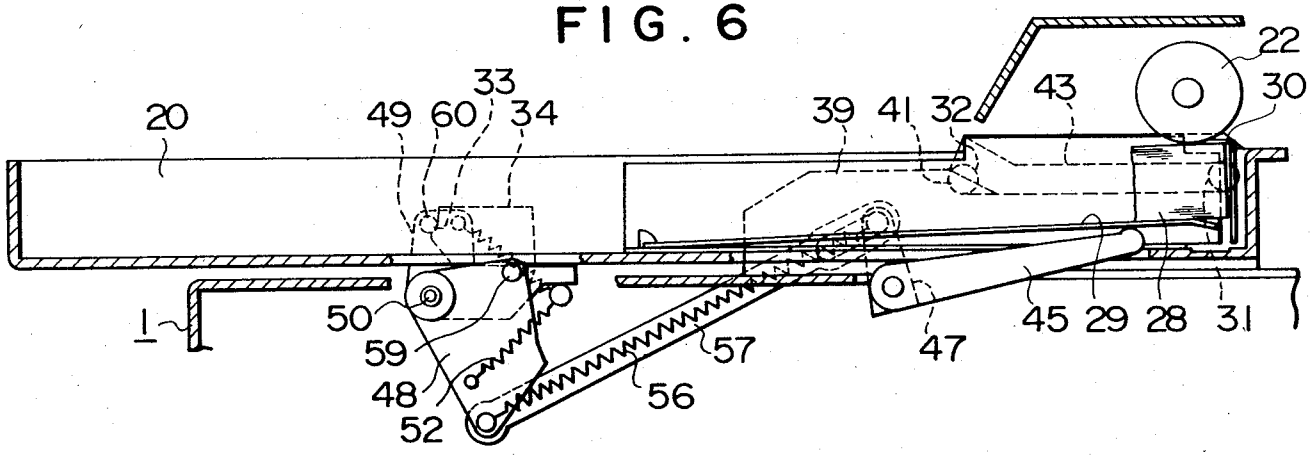

The manner of inserting and drawing out the sheet feeding cassette 20 will be described hereinafter. The sheet feeding cassette 20 is pushed forward with the projections 31 and 32 placed on the steps 21*a* formed on the opposite sides of the cassette receiving section 21. First, the first projections 31 are guided by the supporting surfaces 39 into the openings 40 and enter the guide grooves 43 through the slopes 42, respectively, while the second projections 32 are supported on the supporting surfaces 39, respectively. Accordingly, the sheet feeding cassette 20 is declined toward the front as it is pushed forward, as illustrated in FIG. 5. As the sheet feeding cassette 20 is pushed further forward, the second projections 32 fall vertically through the openings 40 and rest against the stopping surfaces 41, respectively, as shown in FIG. 6, since the second projections 32 are too short to engage the slopes 42. At this moment, a part of the sheet feeding cassette, namely, the lug 34 depresses the operating arm 48 and the pin 60 of the clamping lever 49 engages the recess 33 of the ug 34. When depressed, the operating arm 48 is turned clockwise, whereby the spring 56 is stretched and the intermediate arm 47 and the pressure arm 45 are turned counterclockwise. Consequently, the pressure plate 29 is caused to lift up the sheets 28 to bring the top sheet 28 into contact with the feed roller 22. The remnant sheets decreases as the sheets 28 are separated by the holding fingers 30 and drawn out one by one, however, since the the link 57 is provided with a slot 58 receiving the pin 55 therein, the pressure arm 45 and the intermediate arm 47 are turned counterclockwise by the resilient force of the extension spring 56, and thereby all the sheets 28 to the last sheet 28 are brought successively into contact with the feed roller 22.

In the state shown in FIG. 6, the sheet feeding cassette 20 is unable to be drawn backward, because the second projections 32 are resting against the stopping surface 41 and the pin 60 of the clamping lever 49 engages the recess 33 of the lug 34. Accordingly, in removing the sheet feeding cassette 20 from the cassette receiving section 21, it is necessary to lift up the rear end of the sheet feeding cassette 20 to retract the recess of the lug 34 from the pin 60 of the clamping lever 49 and to bring the second projections 32 above the stopping surfaces 41. After thus lifting up the rear end of the sheet feeding cassette 20, the sheet feeding cassette 20 is drawn backward, so that the second projections 32 are moved away from the guide grooves 43, and then the first projections 31 are moved outside the guide groove 43 along the slopes 42 without interfereing with the stopping surfaces 41. Thus, before drawing the sheet feeding cassette 20, first the rear end of the sheet feeding cassette 20 is lifted up. At the moment when the rear end of the sheet feeding cassette 20 is lifted up, the operating arm 48 is turned counterclockwise by the resilient force of the extension spring 52 to diminish the tension of the extension spring 56. Consequently, the dead weight of the pressure arm 45 and the weight of the sheets 28 turns the pressure arm 45 clockwise to separate the sheets 28 from the feed roller 22. Accordingly, the sheets 28 are not rubbed by the feed roller 22, the sheets 28 are not drawn outside the sheet feeding cassette 20 and the front edges of the same are not bent or the sheets 28 are not creased, even if the sheet feeding cassette 20 containing the remnant sheets 28 is drawn outside the cassette receiving section 21.

Furthermore, the supporting surfaces 39 formed in the cassette guides 36 facilitate guiding the first projections 31 and the second projections 32 to the opening 40. Still further, the supporting surfaces 39 support the second projections 32 thereon to keep the sheet feeding cassette 20 declined toward the front so that the operating arm is released, hence, the sheets 28 are separated from the feed roller 22 at the initial stage of drawing out the sheet feeding cassette 20 from the cassette receiving section 21 and at the final stage of inserting the sheet feeding cassette 20 into the cassette receiving section 21.

Furthermore, the guide surfaces 37 and 38 facilitate guiding the sheet feeding cassette 20 forward and downward.

Still further, since the operating arm 48 and the intermediate arm 47 ae interconnected also by the link 57 having the slot 58, the operating arm 48 and the pressure arm 45 can be interlocked without requiring any large variation of the length of the extension spring 56. The projection connected to the link 57 and to one end of the extension spring 56 may be formed integrally with the pressing arm 45.

Mounting the sheet feeding cassette 20 on the upper surface of the cabinet 1 remarkably reduces the floor space for installing the copying machine.

I claim:

1. A sheet feeding device for a business machine, comprising: a cassette having a pressure plate placed therein for supporting a pile of sheets, and holding fingers for holding down the opposite front corners of the sheets supported on the pressure plate, and adapted to be inserted in a cassette receiving section of a cabinet; first projections formed in the opposite side walls of the cassette so as to project sideways outside the cassette, respectively; second projections formed behind the first projections in the opposite side walls of the cassette so as to project sideways outside the cassette and having a length shorter than that of the first projections, respectively; guide grooves formed in the opposite side walls of the cassette receiving section so as to receive the first and second projections therein with the upper and lower surfaces thereof in contact with the first and second projections, respectively; an inlet opening opening upward, a slope declining from the inlet opening to the guide groove so as to guide only the first projection to the guide groove, and a stopping surface formed directly below the inlet opening so as to restrict the backward movement of the second projection; said inlet opening, said slope and said stopping surfaces being formed in the rear end portion of each said guide groove; a pressure arm pivotally supported in the cassette receiving section so as to press the pressure plate;

an operating arm pivotally supported on one side surface of the cassette receiving section so as to engage a part of the cassette and urged in one direction by a returning spring; and an extension spring interconnecting the operating arm and the pressure arm and applying a resilient force lower than that of the returning spring to the operating arm.

2. A sheet feeding device for a business machine, according to claim 1, wherein a lug is formed on one side wall of the cassette so as to engage the operating arm.

3. A sheet feeding device for a business machine, comprising: a cassette having a pressure plate placed therein for supporting a pile of sheets, and holding fingers for holding down the opposite front corners of the sheets supported on the pressure plate, and adapted to be inserted in a cassette receiving section of a cabinet; first projections formed in the opposite side walls of the cassette so as to project sideways outside the cassette, respectively; second projections formed behind the first projections in the opposite side walls of the cassette so as to project sideways outside the cassette and having a length shorter than that of the first projections, respectively; cassette guides having guide grooves formed so as to receive the first and second projections therein with the upper and lower surfaces thereof in contact with the first and second projections, and disposed on the opposite side surfaces of the cassette receiving section, respectively; an inlet opening opening upward, a slope declining from the inlet opening to the guide groove so as to guide only the first projection to the guide groove, and a stopping surface formed directly below the inlet opening so as to restrict the backward movement of the second projection; said inlet opening, said slope and said stopping surface being formed in the rear end portion of each said guide groove; a guide surface inclined inward toward the interior of the cassette receiving section, and a guide surface declined toward the bottom of the cassette receiving section; both said guide surfaces being formed in the rear end portion of each said cassette guide; a pressure arm pivotally supported in the cassette receiving section so as to press the pressure plate upward from the bottom of the cassette; an operating arm pivotally supported on one side surface of the cassette receiving section so as to engage a part of the cassette and urged in one direction by a returning spring; and an extension spring interconnecting the operating arm and the pressure arm and applying a reslilient force lower than that of the returning spring to the operating arm.

4. A sheet feeding device for a business machine, comprising: a cassette having a pressure plate placed therein for supporting a pile of sheets, and holding fingers for holding down the opposite front corners of the sheets supported on the pressure plate, and adapted to be inserted in a cassette receiving section of a cabinet; first projections formed in the opposite side walls of the cassette so as to project sideways outside the cassette, respectively; second projections formed behind the first projections in the opposite side walls of the cassette so as to project sideways outside the cassette and having a length shorter than that of the first projections, respectively; cassette guides having guide grooves formed so as to receive the first and second projections therein with the upper and lower surfaces thereof in contact with the first and second projections, and disposed on the opposite side surfaces of the cassette receiving section, respectively; an inlet opening opening upward, a slope declining from the inlet opening to the guide groove so as to guide only the first projection to the guide groove, and a stopping surface formed directly below the inlet opening so as to restrict the backward movement of the second projection; said inlet opening, said slope and said stopping surface being formed in the rear end portion of each said guide groove; a supporting surface for slidably guiding the first and second projections to the inlet opening, formed in the rear end portion of each said cassette guide; a pressure arm pivotally supported in the cassette receiving section so as to press the pressure plate upward from the bottom of the cassette; an operating arm pivotally supported on one side surface of the cassette receiving section so as to engage a part of the cassette and urged in one direction by a returning spring; and an extension spring interconnecting the operating arm and the pressure arm and applying a resilient force lower then that of the returning spring to the operating arm.

5. A sheet feeding device for a business machine, comprising: a cassette having a pressure plate place therein for supporting a pile of sheets, and holding fingers for holding down the opposite front corners of the sheets supported on the pressure plate, and adapted to be inserted in a cassette receiving station of a cabinet; first projections formed in the opposite side walls of the cassette so as to project sideways outside the cassette, respectively; second projections formed behind the first projections in the opposite side walls of the cassette so as to project sideways outside the cassette and having a length shorter than that of the first projections, respectively; guide grooves formed in the opposite side walls of the cassette receiving section so as to receive the first and second projections therein with the upper and lower surfaces thereof in contact with the first and second projections, respectively; an inlet opening opening upward, a slope declining from the inlet opening to the guide groove so as to guide only the first projection to the guide groove, and a stopping surface formed directly below the inlet opening so as to restrict the backward movement of the second projection; said inlet opening, said slope and said stopping surface being formed in the rear end portion of each said guide groove; a pressure arm pivotally supported in the cassette receiving section so as to press the pressure plate; an operating arm pivotally supported on one side surface of the cassette receiving section so as to engage a part of the cassette and urged in one direction by a returning spring; an extension spring interconnecting the operating arm and the pressure arm and applying a resilient force lower than that of the returning spring to the operating arm; and a link for transmitting the action of said operating arm with a play to the pressure arm.

* * * * *